United States Patent [19]

Van Bokestal et al.

[11] 4,210,800

[45] Jul. 1, 1980

[54] HEATING ELEMENT COMPRISING A PTC-RESISTOR BODY

[75] Inventors: André M. A. Van Bokestal; Charles J. G. Belhomme, both of Brussels, Belgium

[73] Assignee: U.S. Philips Corporation, New York, N.Y.

[21] Appl. No.: 873,419

[22] Filed: Jan. 30, 1978

[30] Foreign Application Priority Data

Feb. 21, 1977 [NL] Netherlands ..... 7701813

[51] Int. Cl.[2] ..... H05B 3/44

[52] U.S. Cl. ..... 219/544; 174/52 PE; 219/540; 338/22 R; 339/117 R

[58] Field of Search ..... 219/210, 335, 504, 462, 219/530, 538, 541, 544, 540; 338/22 R, 22 SD, 273, 274; 174/52 PE, 52 S; 361/274; 339/101 C, 117 R, 188 R

[56] References Cited

U.S. PATENT DOCUMENTS

| | | | |
|---|---|---|---|
| 2,710,386 | 6/1955 | Hall | 339/117 R |
| 3,251,015 | 5/1966 | Denham | 174/52 PE |
| 3,390,226 | 6/1968 | Beyerlein | 174/52 PE |
| 3,665,155 | 5/1972 | Carolco | 219/538 |
| 3,678,432 | 7/1972 | Boliver | 339/117 R X |
| 3,719,796 | 3/1973 | Abiedtrup | 219/530 X |
| 3,783,345 | 1/1974 | Taylor et al. | 174/52 PE X |
| 3,824,328 | 7/1974 | Ting et al. | 174/52 PE |
| 3,909,683 | 9/1975 | Kysely | 361/274 X |
| 4,072,848 | 2/1978 | Johnson et al. | 219/544 |

*Primary Examiner*—Volodymyr Y. Mayewsky
*Attorney, Agent, or Firm*—Norman N. Spain

[57] ABSTRACT

Self-regulating heating element comprising one or more PTC-resistor bodies enclosed in a synthetic resin filler material mixture. The potting compound is provided with channels. This prevents explosion.

2 Claims, 5 Drawing Figures

HEATING ELEMENT COMPRISING A PTC-RESISTOR BODY

Figure 1:
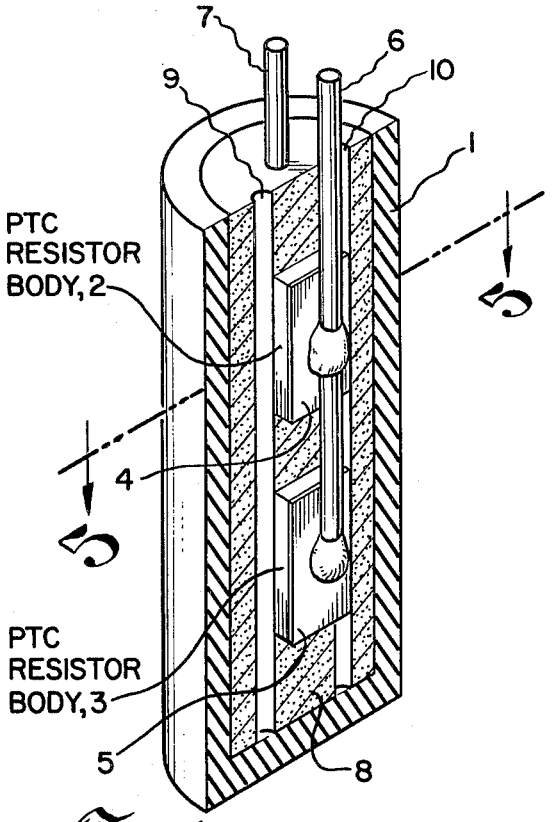

The invention relates to a heating element comprising at least a resistor body provided with current conductors and consisting of a material having a positive temperature coefficient of the electrical resistance, which is surrounded by an electrically insulating potting composition containing a synthetic resin material.

The resistor bodies which are used in self-regulating heating elements usually consist of sintered barium titanate doped with rare earth metals, antimony, niobium or other elements or mixtures thereof with strontium titanate and/or lead titanate.

The heat conductivity of such a material is relatively low and, consequently, also its heat dissipation in air. When loaded, the PTC-resistor attains in air even at a relatively low power consumption the temperature at which the resistance increases rapidly. A relatively small additional increase in temperature then results in a relatively large increase in the resistance. In practice this results in an equilibrium situation wherein the maximum consumed power depends on the heat which can be dissipated. Hereinafter the expression "self-regulating" will be used in this connection.

The above-mentioned patent application proposes the possibility of improving the heat dissipation and, consequently, increasing the maximum consumable power by surrounding the resistor body at all sides by a synthetic resin composition containing a heat-conductive filler material, the composition consisting of a mixture comprising a vulcanized synthetic resin material which is able to withstand the highest operating temperature, an electrically insulating heat-conducting metal compound and a heat-conducting filler material.

As filler material the mixture preferably contains finely dispersed silicon dioxide and/or ground quartz up to a maximum of 50% by weight of the total quantity.

It was found that, when using such a construction, the difference in temperature between the PTC-resistor and the outside of the casing is relatively small during operation and may amount, for example, to less than 25° C. For practicality the assembly is accommodated in a casing which is fabricated from such a composition. The casing may, for example, be in the form of a cylinder. It is, or course, also possible but not necessary to make the resistor bodies also in the form of a cylinder, but they may, however, also be blockshaped.

In practice a vulcanized silicon rubber appears to be particularly suitable as synthetic material. The heat-conductive electrically non-conducting metal compound preferably consists of magnesium oxide, whereas the filler material may, for example, consist of finely dispersed silicon oxide.

It appears that sometimes explosions occur in heating elements when resistor elements having self-regulating properties and produced in the manner as described are used. This may result in damage to the equipment of which the heating element forms part and it is, for example, possible that live components of this equipment become exposed. It is clear that this may result in danger for the user of such equipment.

It has been ascertained that in general the explosions described are the result of defects which take place in spite of all precautions, during manufacture. It appears that these defects may result in the situation wherein during usage of the resistor element a reduction of the PTC-material occurs, this locally reduces the resistance of the material and excessive power is produced in these places so that the temperature can increase in an uncontrollable manner with all its consequences. These phenomena may, for example, occur if, during vulcanization of the synthetic resin material, materials are released in the potting composition which are capable of reducing the PTC-material. It may also occur that by accident, during application of the electrodes, a quantity of electrode material may be deposited in unwanted places. Too high a power can then be locally produced during usage. The temperature may then rise to above the decomposition temperature of the synthetic resin material in the potting composition. On decomposition of the synthetic resin material materials can be produced which are capable of reducing the PTC-material so that the resistance decreases locally and the temperature can increase still further. This may result in a complete destruction of the PTC-material, which makes the occurrence of explosions possible. Further, relatively high operating temperatures certain electrode materials may oxidize resulting in a local breaking of the electrode. Sparking may occur at this break which may also result in decomposition of the synthetic resin material in the potting composition with the result described above. It is an object of the invention to provide a resistor element of the type described in the preamble for which the risk of explosion is at least greatly reduced, even if the circumstances are such that the PTC-material is fully destroyed during usage owing to reduction or for other reasons. It was surprisingly found that this object is accomplished if in accordance with the invention at least one channel is provided in the potting compound, at least one end of which ends on the circumference of the potting composition in an open connection with the surrounding atmosphere. It appears that this measure can effectively prevent the occurrence of explosions while on the other hand, operation and life of the resistance element is not detrimentally affected by this measure. The channels are preferably provided in the potting composition near the resistor bodies. In this connection "near the resistor bodies" must be understood to mean that the channel is disposed at a small but effective distance from the resistor body or bodies and that it also comprises a construction wherein the channel or channels are in an open connection with the surface of the resistance bodies. In a further preferred embodiment of the invention in which the resistor bodies are in the form of blocks and are arranged in a line along the longitudinal axis of a longitudinal casing, the longitudinal axis of at least one of the channels is in parallel to the longitudinal axis of the casing and a portion of the wall of this channel coincides with a portion of the perimeter of the resistor bodies. In practice it appears that reduction of the PTC-material by materials which may happen to be produced in the potting composition during vulcanization of the synthetic resin material no longer occurs. The presence of electrode material in unwanted places on the surface of the resistor material, or the oxidation of the electrode material during prolonged use at high operating temperature while resulting in a possible complete destruction of the resistor material does not result in any detectable explosion.

A preferred embodiment of a resistor element according to the invention will now be described in greater detail with reference to the accompanying drawing.

In this drawing

Figure 2:
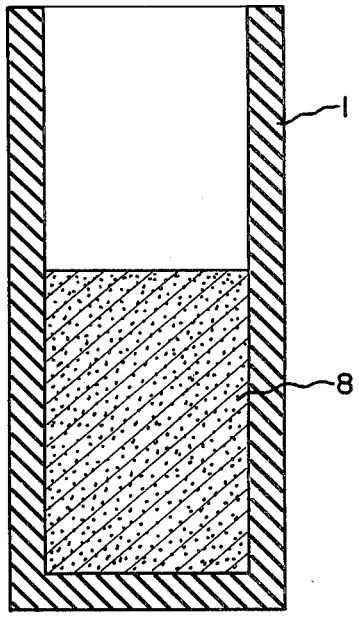
Figure 3:
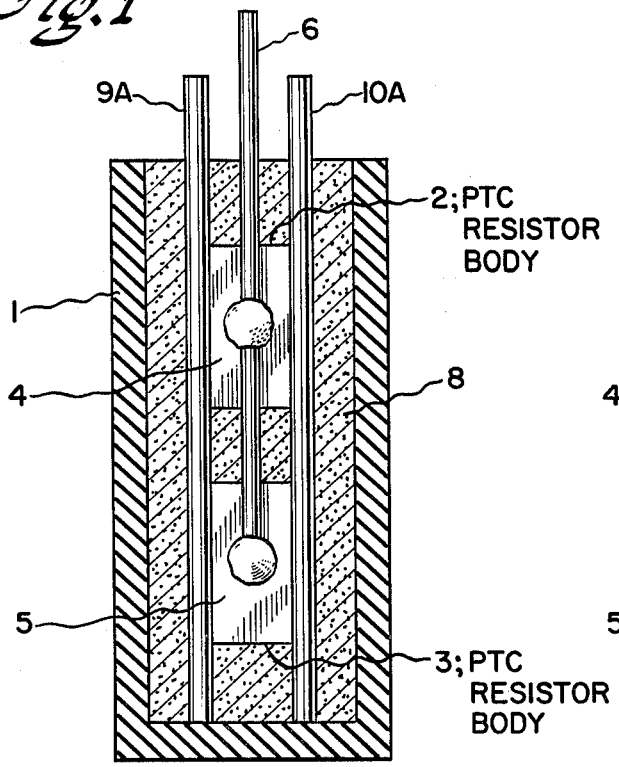
Figure 4:
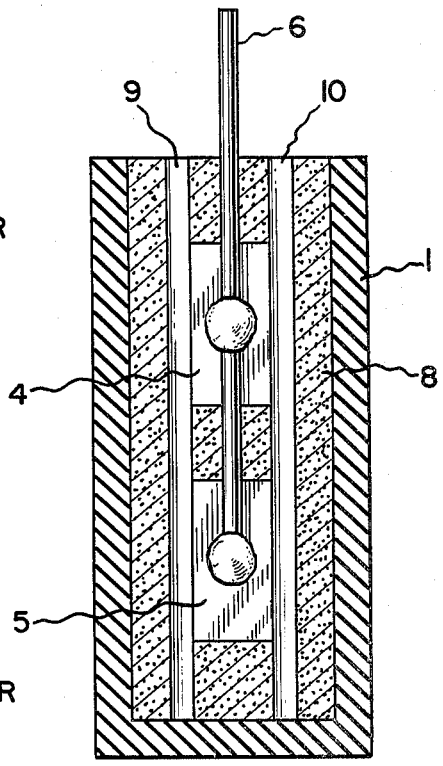

FIG. 1 shows, partly in cross-section, a heating element according to the invention, FIGS. 2 to 4 inclusive show, in cross-section and diagrammatically, several successive stages in the production of heating elements according to the invention.

Figure 5:
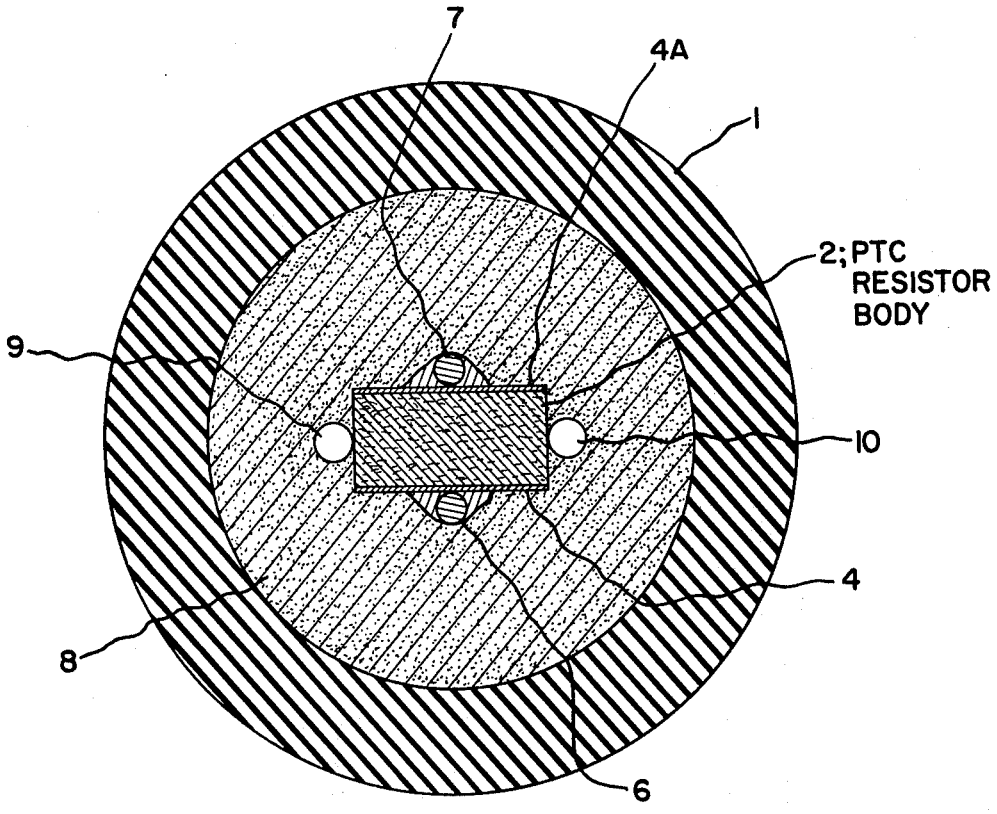

FIG. 5 is a horizontal cross-sectional view along line 5—5 taken through elements 4, 6 and 7 of FIG. 1.

The heating element which is shown in cross-section in FIG. 1 and in FIG. 5 comprises a casing 1, in which two resistor bodies 2 and 3 are disposed. The resistor bodies 2 and 3 are provided with thin metal layer electrodes on substantially parallel surfaces. FIG. 1 shows the electrodes 4 and 5. The resistor bodies can be connected to a voltage source by means of the current conductors 6 and 7. FIG. 5 shows the current areas 4 and 4A supplied with current conductors 6 and 7 respectively. The resistor bodies 2 and 3 are embedded in a composition 8 which contains a heat-conducting metal compound, a filler material and a vulcanized synthetic resin material. The compound 8 is provided with channels 9 and 10.

The casing 1 can be produced by injecting, under pressure, a paste consisting of 15% by weight of hot vulcanizable silicon rubber, 15% by weight of finely dispersed silicon dioxide and 70% by weight of magnesium oxide powder into a suitable melt by means of an injection moulding press. Thereafter the composition is vulcanized under pressure at an elevated temperature (for example 160° C.). The heating element according to the invention can, for example, be produced as follows. A quantity of potting composition 8 is introduced in a casing 1, which was produced at an earlier instant by pressing or injecting, a sufficient quantity of the composition being employed to fully surround the resistor body after it has been introduced into the casing and to fill the remaining room in the casing 1 (FIG. 2). The resistor bodies 2 and 3 whose side faces, provided with electrode areas 4 and 5 with current conductors are visible, are pressed into the composition 8. Thereafter two steel pins 9A and 10A are pushed into the composition as close as possible to the resistor bodies 2 and 3 as far as the bottom of the casing 1 (FIG. 3). Now the potting compound 8 is vulcanized by heating the assembly, for example for 10 minutes at approximately 180° C., until the composition 8 has solidified to such an extent that the pins 9A and 10A can be removed without said channels 9 and 10 in the composition being filled (FIG. 4). The potting composition 8 is now vulcanized further, for example by heating the assembly at 180° C. for 24 hours.

It is of course possible to press the resistor bodies 2 and 3 simultaneously with the pins 9A and 10A into the potting composition 8. It is also possible to add the potting composition 8 after the resistor bodies 2 and 3 and the pins 9A and 10A have been placed in the casing 1. Also in last-mentioned cases the pins 9A and 10A are removed after the composition has vulcanized for some time, whereafter vulcanizing of the composition 8 is continued. The results of the invention are apparent from the following experiments in which celerated life tests are carried out.

A. Thirty PTC-resistors were provided with electrodes consisting of a first layer of a nickel-chromium alloy and a second layer of silver. The electrodes were artificially oxidized to a high degree by heating them for two weeks in air at 300° C. The resistance of the PTC-resistors measured through the electrodes then increased from approximately 1000 Ω to approximately 2000 Ω. Thereafter ten resistors were charged cyclically (10 minutes on, 10 minutes off, 265 V). A few seconds after switch-on sparks were continuously observed at the electrode areas. After several cycles the PTC-resistors started cracking in various places. The remaining twenty resistors were placed, in accordance with the invention, in a synthetic resin casing, (one per casing), ten without channels and ten provided with channels according to the invention. The encapsulated PTC-resistors were thereafter also charged cyclically (10 minutes on, 10 minutes off, 265 V). The ten resistors the potting composition of which was not provided with channels all exploded after 1 to 30 cycles. The ten resistors provided with channels did, indeed, not function anymore because the resistance value increased during charging from 5000 Ω to 1 M Ω, but after 1000 cycles no explosion had occurred.

B. In a following experiment twenty resistor bodies, specially manufactured for this experiment and having a Curie point of 270° C. (PTC-resistors having an operating temperature higher than the temperature in which the silicon rubber in the potting composition is stable) were placed in accordance with the invention in a synthetic resin material casing (one per casing), ten resistors were provided with channels in the potting composition and ten were not. The resistor bodies were continuously charged with 265 V. The ten resistors without channels all exploded between 12 and 48 hours after the beginning of the charging operation. None of the ten resistors provided with channels in the potting composition were defective after having been charged continuously for 1000 hours.

What is claimed is:

1. A heating element comprising at least one positive temperature coefficient resistor body embedded in a heat conductive potting composition, said heat conductive potting composition surrounded by a heat conductive casing except for one surface thereof open to the atmosphere, electric current conductor means attached to said positive temperature coefficient resistor body and extending through said potting composition and out of said heat conductive casing and as a means for preventing explosions from occurring in said heating element, at least one channel positioned in said potting composition within a heat-effective distance from said resistor body, an end of which channel is situated at the surface of said potting composition open to the atmosphere.

2. The heating element of claim 1 at least two resistor bodies are present and are in the form of blocks, embedded in line within a longitudinal casing in a potting composition, wherein at least one channel has a longitudinal axis parallel with the longitudinal axis of said longitudinal casing and a portion of the wall of this channel coincides with a portion of the peripheries of said resistor bodies.

* * * * *